US006138875A

United States Patent [19]

Condon et al.

[11] Patent Number: 6,138,875

[45] Date of Patent: Oct. 31, 2000

[54] HAND-OPERATED FOAMING APPARATUS

[75] Inventors: Gregory C. Condon, Batavia; William C. Bouton, Alexander, both of N.Y.

[73] Assignee: Chapin Manufacturing, Inc., Batavia, N.Y.

[21] Appl. No.: 09/400,669

[22] Filed: Sep. 21, 1999

Related U.S. Application Data

[60] Provisional application No. 60/140,203, Jun. 22, 1999.

[51] Int. Cl.[7] ..... B65D 83/00

[52] U.S. Cl. ..... 222/402; 222/401

[58] Field of Search ..... 222/401, 402

[56] References Cited

U.S. PATENT DOCUMENTS

| | | | |
|---|---|---|---|
| Re. 33,564 | 4/1991 | Ford, Jr. | 222/401 |
| 2,171,142 | 8/1939 | Doh | 222/401 |
| 2,653,848 | 9/1953 | Lee | 222/190 |
| 3,121,518 | 2/1964 | Pinke | 222/402 |
| 3,709,409 | 1/1973 | Collins | 222/402 |
| 3,831,850 | 8/1974 | Hunter . | |
| 3,970,219 | 7/1976 | Spitzer et al. . | |
| 4,531,659 | 7/1985 | Wright . | |
| 4,875,781 | 10/1989 | Raska . | |
| 4,880,312 | 11/1989 | Carlson . | |
| 4,930,664 | 6/1990 | Ellison | 222/401 |
| 4,984,742 | 1/1991 | Ellison et al. | 222/401 |
| 5,037,006 | 8/1991 | Kock . | |
| 5,314,096 | 5/1994 | Fesl et al. | 222/401 |
| 5,435,469 | 7/1995 | Gager et al. | 222/402 |

*Primary Examiner*—J. Casimer Jacyna

*Attorney, Agent, or Firm*—Jaeckle Fleischmann & Mugel, LLP

[57] ABSTRACT

A hand-held foaming apparatus includes a pressure vessel for containing a foamable liquid and an air space overlying the liquid. A hand pump is mounted within the vessel and sealably connected to a sealable opening at the top of the vessel. The pump comprises an external handle connected to a piston that extends substantially to the bottom of the vessel. Actuating the pump by operating the handle causes formation of foam from the foamable liquid in the overlying air space and discharge of the foam from a foam discharge outlet that comprises foam discharge control means and is located on the vessel above the air space.

18 Claims, 2 Drawing Sheets

FIG. 3
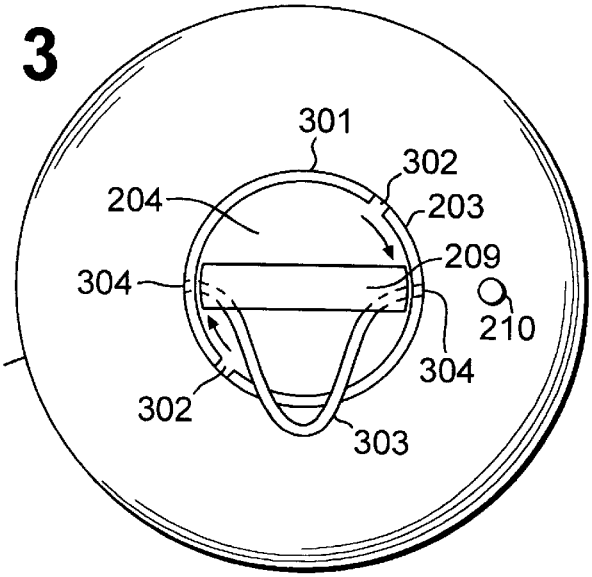
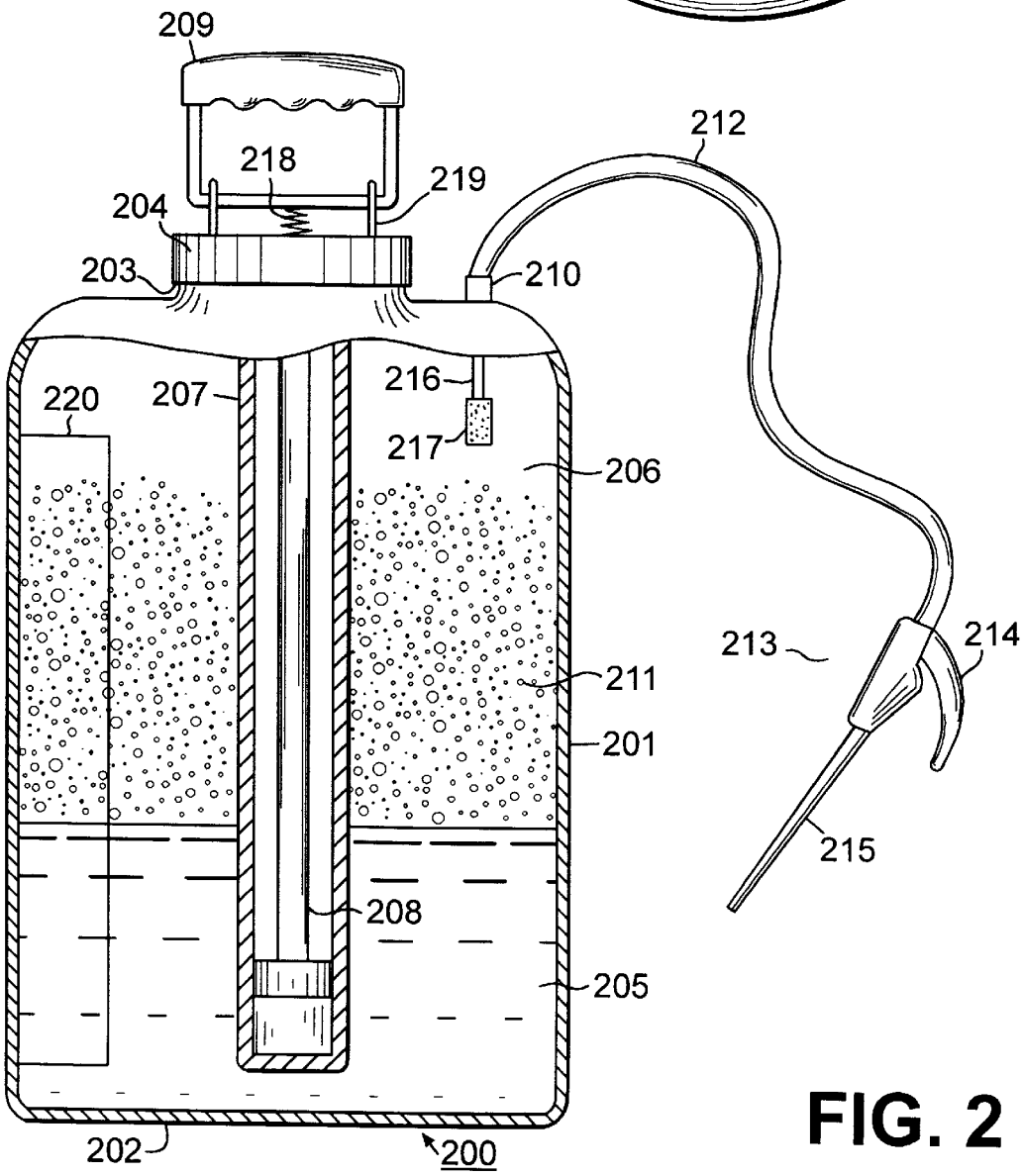
FIG. 2

HAND-OPERATED FOAMING APPARATUS

CROSS-REFERENCE TO RELATED APPLICATION

This application claims priority from Provisional Application Serial No. 60/140,203, filed Jun. 22, 1999, for HAND-HELD FOAMING APPARATUS.

FIELD OF THE INVENTION

The present invention relates to foaming apparatus and, more particularly, to a hand-held foaming apparatus that provides for formation and discharge of foam by a hand pump mounted within a vessel containing a foamable fluid.

BACKGROUND OF THE INVENTION

It is often desirable to deposit a thick foam of insectide, herbicides and other materials. Foams are useful for several reasons. First of all, foams are economically better than liquid sprays. A foam consumes substantially less material than a liquid spray. As such, foams also improve the environmental impact of using insecticide and herbicides since less of those hazardous materials are used to achieve equal or better results. Where a given insecticide application might require gallons of liquid, a corresponding foaming application may require only ounces.

Foaming devices known in the art are frequently of complex design and consequently expensive to manufacture. Typically they require both an air compressor and a liquid pump, the output from the compressor and the pump being directed to a turbulence chamber where they are mixed with a liquid in order to produce foam.

U.S. Pat. No. 2,653,848 to Lee discloses a device for attachment to an existing container, for example, a conventional tin-plate container or a glass gallon jug. A solution in the container is agitated to form bubbles, and the resulting foam is dispensed from the device. Included in the device is a pump with a tubular body that has a screw thread for attachment to the container. The body of the pump is divided by an air-tight partition into two chambers, the upper chamber containing a hand pump piston, the lower being a chamber for condensing the foam. The upper chamber is connected to an air injector tube that extends below the level of the liquid in the container, and the lower chamber is connected by a nipple to a foamer hose that has a length that is about 65 times its base diameter.

U.S. Pat. No. 3,970,219 to Spitzer et al. discloses an aerosol container for foaming and delivering an aerosol. It has a pressurized container with a valve for opening and closing a delivery port. The container is divided into two compartments by a porous bubbler that provides the only fluid communication between the two compartments. The first compartment contains foam, which is dispensed through the port when the valve is opened to the atmosphere. The second compartment contains compressed propellant gas, for example, nitrogen, air, a hydrocarbon, or a fluorocarbon.

U.S. Pat. No. 4,531,659 to Wright and U.S. Pat. No. 5,037,006 to Kock both disclose squeeze bottle devices that include a container for a foamable liquid. Foam is dispensed from an outlet of the device when the container is in an inverted position.

U.S. Pat. Nos. 3,831,850 to Hunter, 4,875,781 to Raska, and 4,880,312 to Carlson a disclose mixing containers from which paint can be dispensed. Each has an interior vane or baffle for agitating the paint mixture. U.S. Pat. No. 5,314, 096 to Fesl et al. shows mixing vanes mounted on a hand pump. Operating the pump causes the vanes to turn.

A need remains for a hand-held foaming apparatus that is readily manufactured and easily operated. The present invention meets this need.

SUMMARY OF THE INVENTION

The present invention is directed to a hand-held foaming apparatus that includes a pressure vessel for containing a foamable liquid and an air space overlying the liquid. A hand pump is mounted within the vessel and sealably connected to a sealable opening at the top of the vessel. The pump comprises an external handle connected to a piston that extends substantially to the bottom of the vessel. Actuating the pump by operating the handle causes formation of foam from the foamable liquid in the overlying air space and discharge of the foam from a foam discharge outlet that comprises foam discharge control means and is located on the vessel above the air space.

BRIEF DESCRIPTION OF THE DRAWINGS

FIG. 2 is a cross-sectional side view of a larger apparatus of the present invention that is suitable for heavy duty industrial use.

FIG. 3 is a top view of the apparatus depicted in FIG. 2.

DETAILED DESCRIPTION OF THE INVENTION

Figure 1:
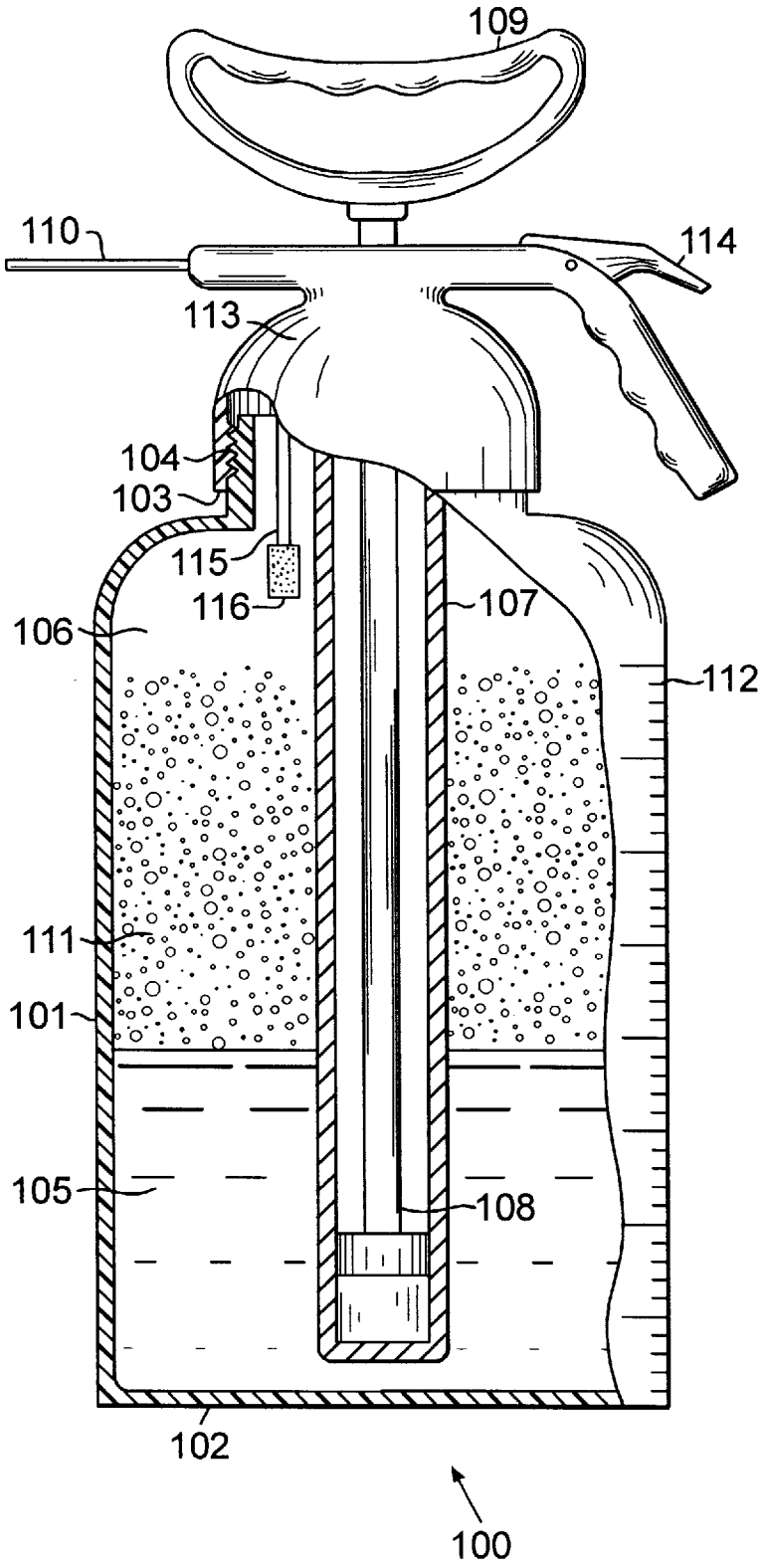
FIG. 1 is a partial cross-sectional side view of a hand-held foaming apparatus 100 of the present invention.

FIG. 1 is a partial cross-sectional side view of a hand-held foaming apparatus 100 in accordance with the present invention. Apparatus 100 includes a container or vessel 101 having a substantially flat bottom 102 and a sealable top opening 103 provided with, preferably, a screw thread 104. Vessel 101, which preferably is formed from a plastic such as polypropylene, provides a container for a foamable liquid 105 and an overlying air space 106. A pump 107 provided with a piston 108 connected to an external handle 109 is sealably mounted within container 101, piston 108 extending substantially to the bottom 102 of vessel 101.

Apparatus 100 further includes a foam discharge outlet 110 for dispensing foam 111 formed from liquid 105 in air space 106. Vessel 101 can be provided with a scale of markings 112 to indicate the volume of liquid 105 contained therein. Preferably, vessel 101 is sealably closed by a threaded cap 113 that includes a trigger 114 for opening and closing foam discharge outlet 110 via a trigger valve (not shown). Cap 113 further provides for sealably mounting pump 107 within container 101. A discharge tube 115 extends from cap 113 into air space 106 and terminates above the level of liquid 105. Discharge tube 115 preferably is provided with a filter 116 and is connected through the trigger valve (not shown) to foam discharge outlet 110 and pump handle 109.

In the operation of apparatus 100, pump handle 109 is reciprocated up and down in order to force air into air space 106, thereby provide a source of pressure for dispensing foam 111. A detergent or soap is preferably included in liquid 105 to promote formation of foam 111. A user can agitate the pressurized liquid 105 by sloshing it back and forth or shaking it, causing bubbles of foam 111 to form in airspace 106. Operation of trigger 114 results in discharge through outlet 110 of a thick foam, which results from the air pressure acting on the bubbles within container 101. As air pressure is relieved and the bubbles escape through a relatively small orifice of discharge outlet 110, the operation of apparatus 100 causes a capillary-like action that continuously creates bubbles that form a thick foam upon discharge. The foaming action continues until the pressure is exhausted or trigger 114 is released.

FIG. 2 is a cross-sectional side view of a larger apparatus 200, in accordance with the present invention, that is suitable for heavy duty industrial use but whose mode of operation is similar to that of apparatus 100. Apparatus 200 includes a container or vessel 201 having a substantially flat bottom 202 and a top opening 203 sealable by a cap 204. Vessel 201, which preferably is formed from stainless steel but may also be made from a plastic such as polypropylene, provides a container for a foamable liquid 205 and an overlying air space 206. A pump 207 provided with a piston 208 connected to an external handle 209 is sealably mounted within container 201, piston 208 extending substantially to the bottom 202 of vessel 201.

Cap 204, which is sealable to vessel 201 preferably by a rotatably locking mechanism, as shown in FIG. 3, further provides for sealably mounting pump 207 within vessel 201. Apparatus 200 further includes a foam discharge outlet 210 located above air space 206 for dispensing foam 211 formed from liquid 205. Discharge outlet 210 is provided with a hose 212 and a foam delivery gun 213 that includes a trigger 214 and nozzle 215. A discharge tube 216 extends from discharge outlet 210 into air space 206 and terminates above the level of liquid 205. Discharge tube 216 preferably is provided with a filter 217, which can be formed from bronze.

Fluid 205 in vessel 201 can be agitated by rotating handle 209 clockwise and counterclockwise. Handle 209 can be biased against cap 204 by a spring 218 and releasably locked by handle lock 219. Agitation can be increased by the presence of an agitation baffle 220 that is welded or otherwise fixed to the inner surface of vessel 201.

FIG. 3 is a top view of apparatus 200 depicted in FIG. 2. Shown in FIG. 3 is vessel 201, top opening 203, cap 204, pump handle 209, and discharge outlet 210, as described in the discussion of FIG. 2. Opening 203 is provided with a channel flange 301 containing two diametrically opposed notches 302. Cap 204 is provided with a locking lever 303 whose end pins 304 can be inserted into notches 302. Following insertion of pins 304 into notches 302, cap 204 and handle 209 can be rotated and locking lever 303 can be pushed downwards against cap 204, thereby sealing cap 204 in opening 203. Lifting lever 303 and rotating cap 204 and handle 209 in the opposite direction serves to release the seal. Cap 204 can be further provided with a gasket (not shown) to enhance its seal with opening 203.

Having thus described the preferred embodiment of the invention, those skilled in the art will appreciate that various modifications, additions, and changes may be made thereto without departing from the spirit and scope of the invention, as set forth in the following claims.

What is claimed:

1. A hand-held foaming apparatus comprising:

a pressure vessel for containing a foamable liquid and an air space overlying said liquid, said vessel having a bottom and a sealable top opening;

a hand pump mounted within said vessel and sealably connected to said top opening, said pump comprising an external handle connected to a piston extending substantially to the bottom of said vessel and operable to force air under pressure into said vessel; and a foam discharge outlet conduit disposed on said vessel and extending into said vessel and terminating in the air space above the foamable liquid, said foam discharge outlet comprising foam discharge control means;

wherein actuating said pump by operating said handle pressurizes said vessel and agitating said foamable liquid causes formation of foam in said air space from said foamable liquid and enables discharge of said foam from said discharge outlet.

2. The foaming apparatus of claim 1 further comprising a cap for sealably closing said top opening and for supporting said pump.

3. The foaming apparatus of claim 2 wherein said top opening and said cap are provided with corresponding screw threads for sealably closing said vessel.

4. The foaming apparatus of claim 2 wherein said top opening is provided with a notched channel flange and said cap is provided with a locking lever having end pins, said flange and said lever operating to sealably close said vessel.

5. The foaming apparatus of claim 2 wherein said cap further comprises said foam discharge outlet and said foam discharge control means.

6. The foaming apparatus of claim 2 wherein said cap further comprises a discharge tube extending into and terminating in said air space.

7. The foaming apparatus of claim 6 wherein said discharge tube further comprises a filter.

8. The foaming apparatus of claim 2 wherein said cap is further provided with a handle lock for releasably locking said handle of said pump to said cap.

9. The foaming apparatus of claim 1 wherein said foam discharge outlet is connected to a hose, said hose being connected in turn with a foam delivery gun.

10. The foaming apparatus of claim 9 wherein said foam delivery gun comprises a trigger and a nozzle.

11. The foaming apparatus of claim 1 wherein said vessel is formed from metal.

12. The foaming apparatus of claim 11 wherein said vessel is formed from stainless steel.

13. The foaming apparatus of claim 1 wherein said vessel is provided with a scale of volume markings.

14. The foaming apparatus of claim 1 further comprising an agitation baffle fixed within said vessel.

15. The foaming apparatus of claim 1 wherein said vessel is formed from plastic.

16. The foaming apparatus of claim 15 wherein said vessel is formed from polypropylene.

17. The foaming apparatus of claim 1 wherein said vessel has a substantially flat bottom.

18. The foaming apparatus of claim 1 wherein said foam discharge control means comprises a trigger for opening and closing said foam discharge outlet.

* * * * *